United States Patent [19]

Lampard

[11] Patent Number: 4,823,415

[45] Date of Patent: Apr. 25, 1989

[54] CONVERTIBLE INFANT BED

[76] Inventor: Lucille B. Lampard, 1008 Martin Behrman Walk, Metairie, La. 70005

[21] Appl. No.: 133,375

[22] Filed: Dec. 15, 1987

[51] Int. Cl.[4] ..... A47C 29/00; A47D 7/01

[52] U.S. Cl. ..... 5/93 R; 5/97; 5/100; 5/414; 5/186 R

[58] Field of Search ..... 49/372; 5/97, 93 R, 5/100, 113, 414, 416, 415, 53 R, 11, 186 R

[56] References Cited

U.S. PATENT DOCUMENTS

| | | | |
|---|---|---|---|
| D. 231,874 | 6/1974 | Weigel | 5/100 |
| 949,389 | 2/1910 | Almgren | 5/100 |
| 1,594,256 | 2/1926 | Greene | 5/97 |
| 1,776,440 | 9/1930 | Knowles | 5/97 |
| 2,059,240 | 11/1936 | Johnston | 5/100 |
| 2,442,048 | 5/1948 | Kroll et al. | 5/100 |
| 2,477,231 | 7/1949 | Bourdon | 5/100 |
| 2,530,728 | 11/1950 | Ream | 5/97 |
| 2,889,560 | 6/1959 | Carman | 5/100 |
| 2,958,084 | 11/1960 | Kenney | 5/99 R |
| 3,188,661 | 6/1965 | Rudy | 5/97 |
| 3,344,442 | 10/1967 | Andrews | 5/100 |
| 3,403,412 | 10/1968 | Gottfried | 5/100 |
| 4,043,349 | 8/1977 | Gays et al. | 5/97 |
| 4,359,792 | 11/1982 | Dale | 5/100 |
| 4,359,793 | 11/1982 | Hosono | 5/100 |

FOREIGN PATENT DOCUMENTS

| | | | |
|---|---|---|---|
| 8814/27 | of 1927 | Australia | 5/97 |
| 2822981 | 11/1979 | Fed. Rep. of Germany | 5/100 |
| 404314 | 1/1934 | United Kingdom | 5/97 |

*Primary Examiner*—Alexander Grosz
*Assistant Examiner*—Eric K. Nicholson
*Attorney, Agent, or Firm*—Pravel, Gambrell, Hewitt, Kimball & Krieger

[57] ABSTRACT

A convertible bed for infants and small children wherein the crib transforms from a crib configuration for small infants to a bed that prevents toddlers from inadvertently climbing out of the bed and later to a small child's bed, wherein the child can freely enter and leave the bed at will, thus prolonging the life of the bed from the time of birth of the infant to ages six to eight (6–8) years old.

10 Claims, 5 Drawing Sheets

CONVERTIBLE INFANT BED

BACKGROUND OF THE INVENTION

1. Field of the Invention

The present invention relates to cribs and infant beds, and more particularly relates to a convertible bed for infants and small children wherein the crib transforms from a crib configuration for small infants to a bed that prevents toddlers from inadvertently climbing out of the bed and later to a small child's bed, wherein the child can freely enter and leave the bed at will, thus prolonging the life of the bed from the time of birth of the infant to ages six to eight (6–8) years old.

2. General Background

Many cribs are commercially available which are typically purchased when a child is born and used usually for a year or two after which time the cribs become unsafe because the child begins to crawl, stand and even walk. This increased mobility of the child creates a hazardous situation if the child is kept in a small infant crib because the child can climb over the railing of the crib and fall to the floor. Typically such infant cribs have mattresses that are high relative to the floor so that the mother can easily pick up the child and easily place the child back in the crib. Many cribs have decorative raised covers or canopies spaced a distance above the crib.

Generally, these prior art commercially available cribs are of little utility when the child passes the 1–2 year mark because they are a source of potential hazard when the child begins to climb and/or stand because of the problem of a potential fall.

Several bed/crib constructions have been patented which relate to convertible cribs and/or beds. A number of prior patents discuss the concept of a crib having a canopy or other structure fitted to the crib which is removable. Examples of patents having canopies are U.S. Pat. Nos. 2,530,728, issued to Ream; 2,958,084, issued to Kenney; 3,344,442, issued to Andrews et al.; 4,043,349, issued to Gays et al.; and 4,359,792, issued to Dale.

The Ream U.S. Pat. No. 2,530,728 shows a crib having a flat hinged safety top which can be positioned on a typical baby bed or crib without the necessary of making alterations to the bed structure to mount the safety top thereon.

The Kenney U.S. Pat. No. 2,958,084 discloses a playpen having a flat canopy or sunshade mounted to the top of the crib at four cornered posts in a suspended position above the playpen.

The Andrews et al. U.S. Pat. No. 3,344,442 discloses a transparent plastic bubble composed of a truncated pyramid base on the top that is mounted on sliding tracks with means for locking and unlocking the plastic bubble with respect to the crib.

The Gays et al. U.S. Pat. No. 4,043,349 describes a canopy apparatus for use in combination with a conventional child's crib. The canopy apparatus comprises a frame including a plurality of sides a plurality of support members interconnecting two of the plurality of sides and a cover secured to the frame and supported by the support members. The canopy is mounted on and secured to an upper rail of one side wall of the crib by at least one pivot clamp and may be retained in a closed position over the crib by at least one retaining clamp.

The Dale U. S. Pat. No. 4,359,792 discloses a crib formed of walls of mesh in order to eliminate a multiplicity of rigid vertical bars. In addition, a hemispherically shaped canopy of similar mesh structure is fitted to the crib. This canopy has sections which can be pivoted to an open position to obtain access to the crib.

These prior art patents all disclose crib covers which are directed to the problem of covering the crib rather than functioning as both a canopy in a raised position, as well as a protective cover for the crib and in combination with an overall bed structure which expands as the child progresses in years to the toddler ages and to the age of even six or eight years old, for example.

Many patents have issued which show cribs or beds having access doorways, but these doorways are primarily designed for use by the parents in accessing the interior of the bed to remove the child therefrom, rather than to the problem of providing an overall convertible bed apparatus which is expandable and convertible so that it can be used for infants and for a much longer period of time by a growing child both to sleep in and to play in. Examples of patents describing cribs with doorways include the U.S. Pat. Nos. the Almgren 949,389; the Knowles 1,776,440; the Bourdon 2,477,231; and Des. 231,874 issued to Weigel et al. These patents describe doorways which fold away from the crib allowing access to the crib from the exterior of the crib during the infant years, and from the interior of the crib during later years when the growing child uses the crib for sleeping as well as play.

SUMMARY OF THE PRESENT INVENTION

The present invention thus provides a convertible bed for infants and toddlers which can be used for a number of years, including (1) initial use as a crib for an infant (2) a protective enclosure for young toddlers beginning to climb and stand; and (3) a combination play area and bed for small children as old as six to eight years, for example. This solution is accomplished by a unique convertible crib-bed apparatus that includes a pair of spaced apart headboards and a pair of sides, at least one of the sides having a movable portion that can be lowered. The headboards and sides defining in combination a bed frame with an interior area. A mattress support is carried by the frame and is vertically adjustable with respect to the frame, so that as the infant of a few months in age grows to be a toddler of a few years in age, the mattress can be accordingly lowered. A domed canopy is provided which is removably supported above the top of the headboards.

A first removable connection is provided for assembling and disassembling the canopy and the posts so that the canopy can be supported at a distance spaced above the top of the headboards which allows a parent to lift an infant into or out of the bed interior. This allows the canopy to function as a raised canopy while the child is an infant of a few months in age. A second removable connection is provided for mounting the canopy directly upon the headboards and to form a closure over the bed interior with the headboards and sides so that a growing toddler cannot escape the bed by climbing over the side or over a headboard of the bed. The domed canopy defines an increased head room area above the sides to accommodate a toddler standing on the mattress when the toddler extends above the surface of the sides. One or more access doorways are formed in at least one of the headboards and is operable from both inside and outside of the bed interior area so that a toddler can enter and leave the bed interior at will. For example, two sliding door panels could be provided at one headboard.

BRIEF DESCRIPTION OF THE DRAWINGS

A better understanding of the invention can be had when the detailed description of a preferred embodiment set forth below is considered in conjunction with the drawings, in which.

Figure 1:
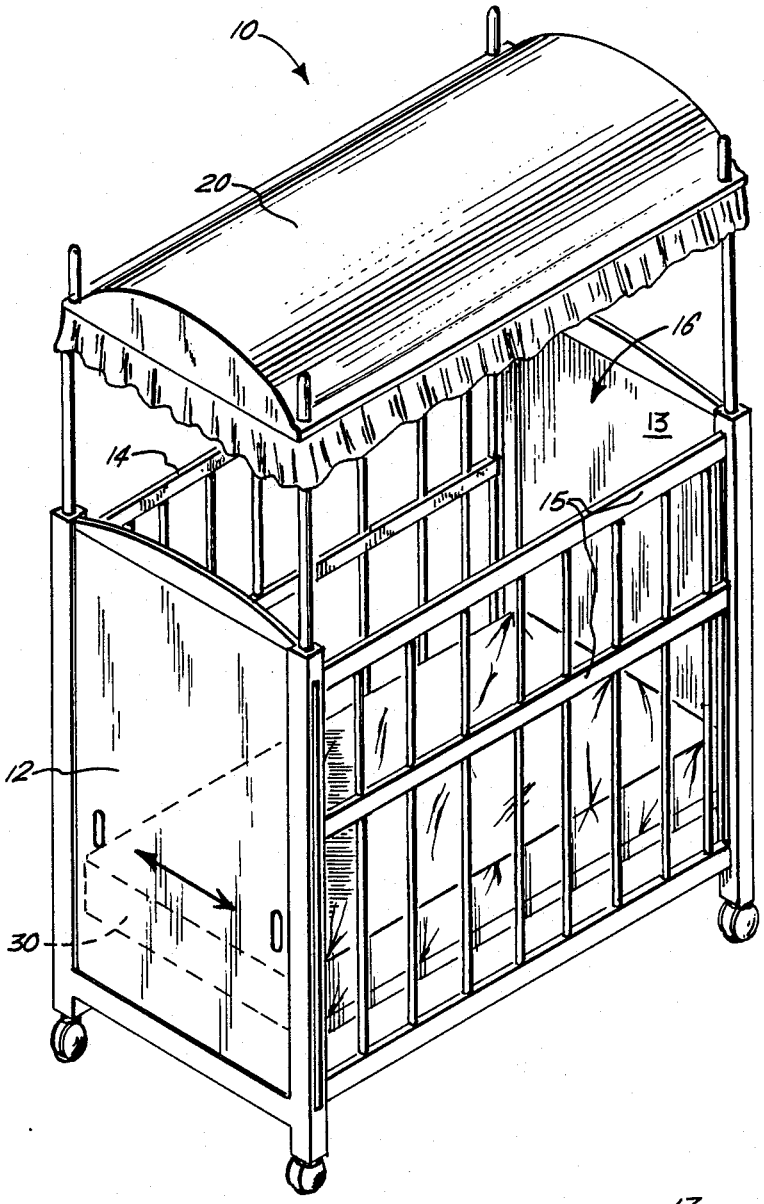
FIG. 1 is a perspective view of the preferred embodiment apparatus of the present invention.

DETAILED DESCRIPTION OF THE PREFERRED EMBODIMENT:

FIGS. 1, 3, 5, and 7–8 illustrate generally the preferred embodiment of the apparatus of the present invention designated generally by the numeral 10. Convertible bed 10 provides an apparatus that can function as a crib (see FIGS. 1 and 7), and later as a toddler's bed which allows a toddler to go into or out of the bed by opening the sliding door at the end of the bed (see FIGS. 3 and 4).

The apparatus includes a pair of spaced apart headboards 12, 13 and a pair of sides 14, 15, at least one of the sides having a movable portion that can be lowered. The headboards 12, 13 and sides 14, 15 define a bed frame having an interior area 16.

Figure 2:
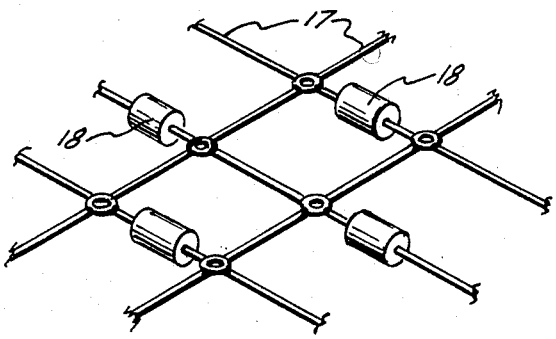
FIG. 2 is a fragmentary view illustrating the mattress support portion of the preferred embodiment of the apparatus of the present invention.
Figure 4:
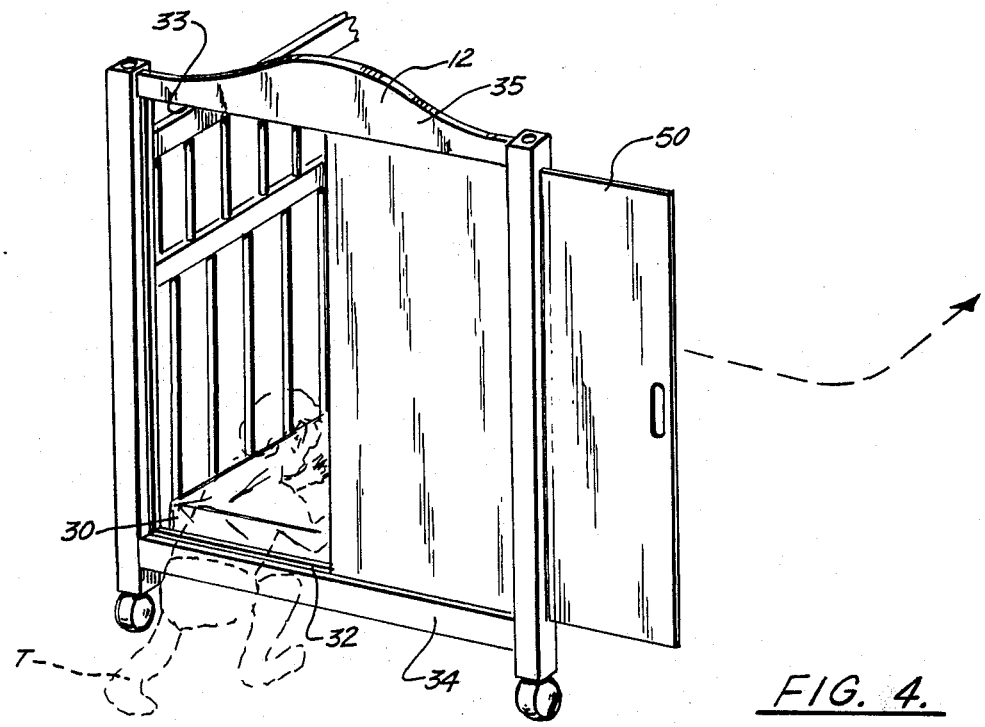
FIG. 4 is a fragmentary perspective view illustrating use of the end door by a toddler with a mattress in a lowered position.

A mattress support 17 can be in the form, for example, of a plurality of horizontally extending, interconnected wires, as best seen in FIG. 2, equipped with rollers 18. The support 17 would include a peripheral support 19 of generally rectangular configuration, comprised, for example, of angled iron (see FIG. 6). Support 17 would be carried by the frame and would be vertically adjustable with respect to the frame so that as the infant grows to be a toddler, the mattress can be lowered to a lowermost position, as best seen in FIGS. 4 and 8.

A domed canopy 20 includes curved end portions 21, and longitudinally extending slats 22. The end portions of curved members 21 are provided with openings 23 through which threaded knobs 24 can pass and form a threaded connection with posts 25, as best seen in FIG. 8. The lowermost portion of posts 25 provide similarly threaded end portions 26 so that when posts 25 are removed, the threaded knobs 25 can connect directly to the headboard side posts 27 (see FIGS. 3, 5, 7 and 8).

Figure 3:
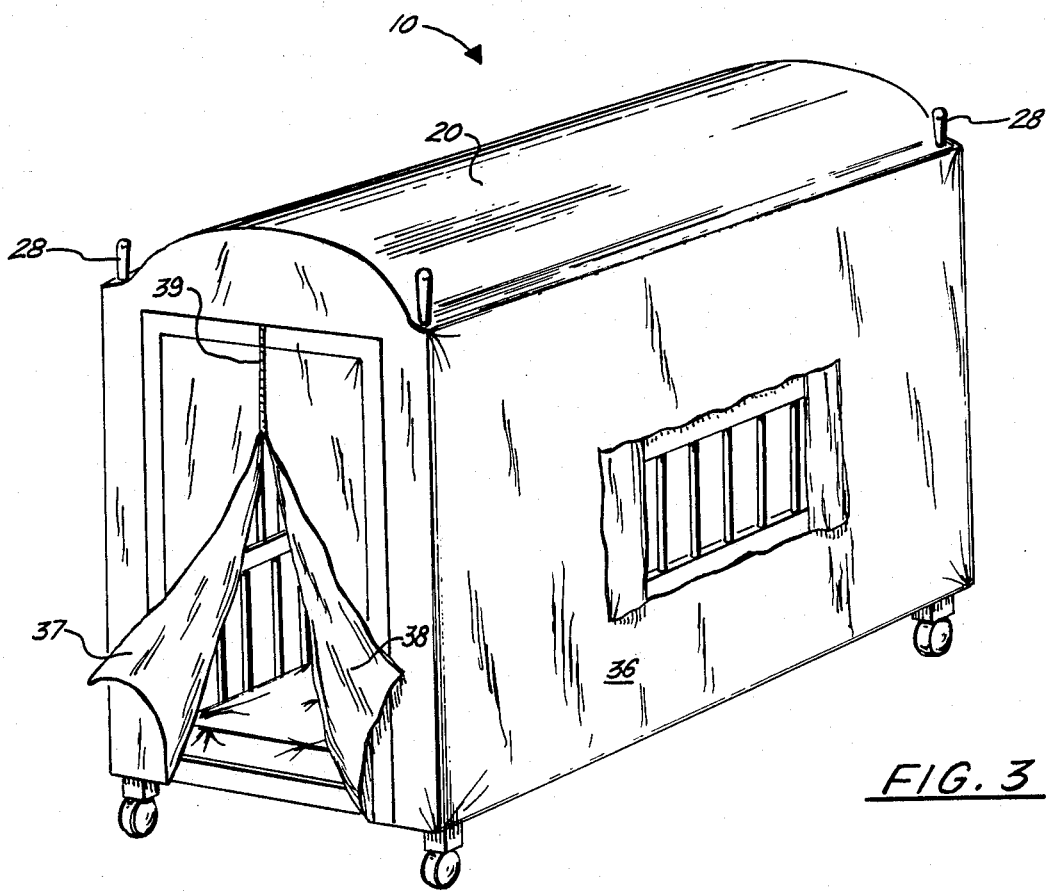
FIG. 3 a perspective view of the preferred embodiment of the apparatus of the present invention showing the mattress in a lowered position and canopy mounted directly upon the frame with an exemplary cover, thus illustrating the apparatus as used by an older toddler.
Figure 5:
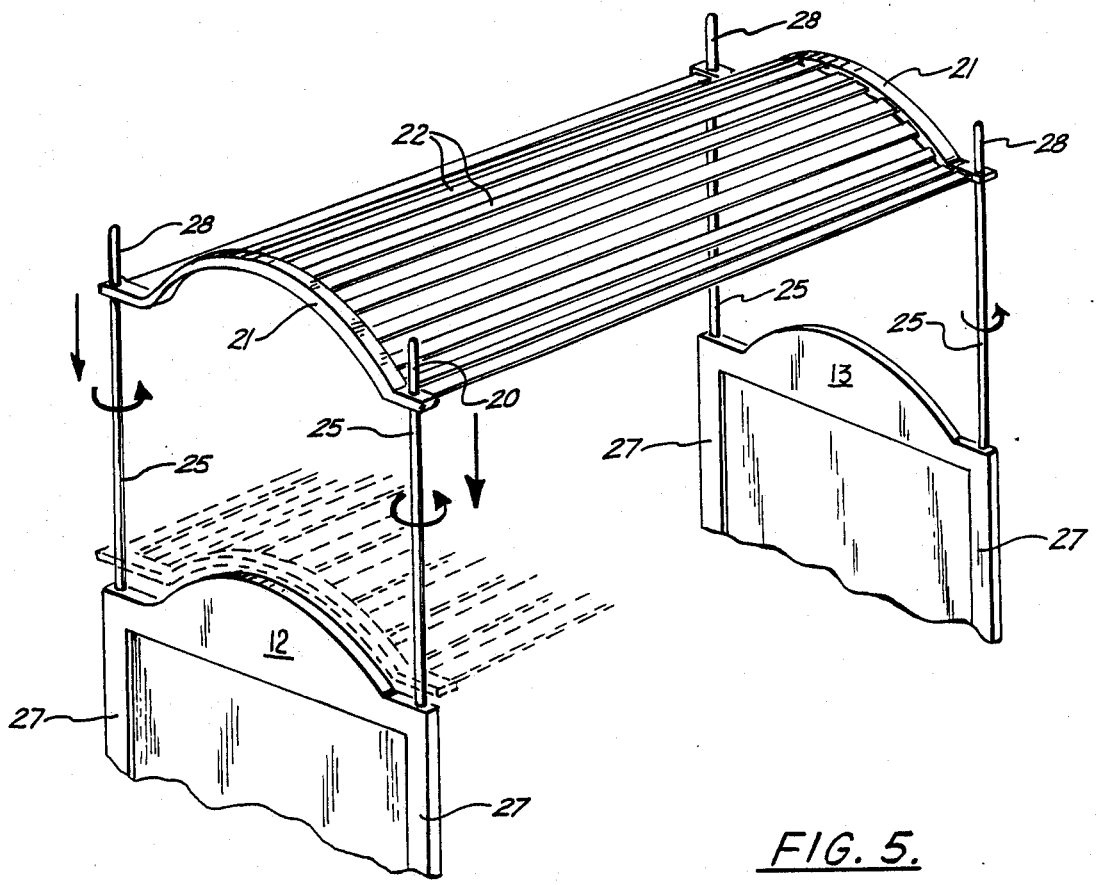
FIG. 5 is a fragmentary perspective view illustrating the canopy and its upper and lower positions with respect to the bed frame, and more particularly the headboard portions thereof.
Figure 6:
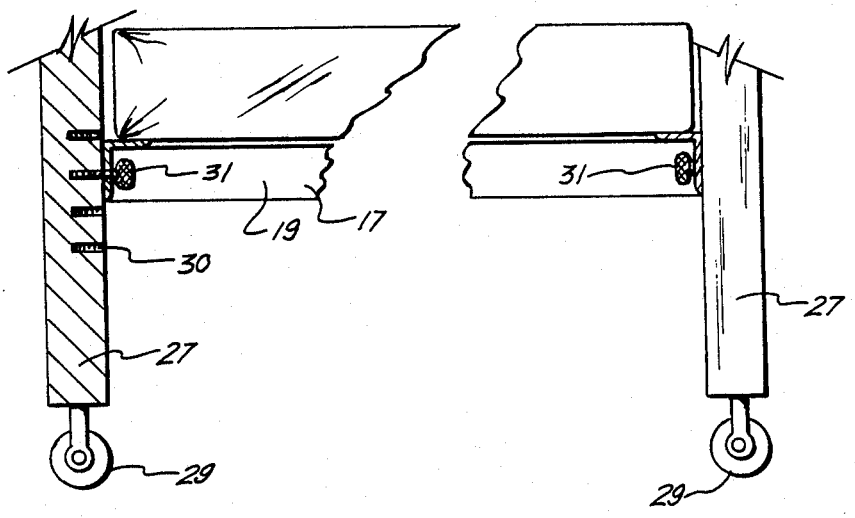
FIG. 6 is a sectional fragmentary view illustrating the adjustable connection of the mattress support to the bed frame.
Figure 8:
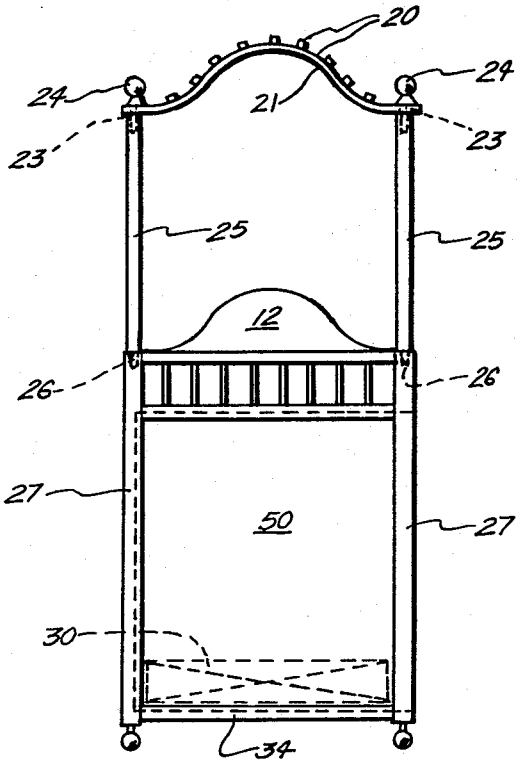
FIG. 8 is an end view of the preferred embodiment of the apparatus of the present invention.
Figure 7:
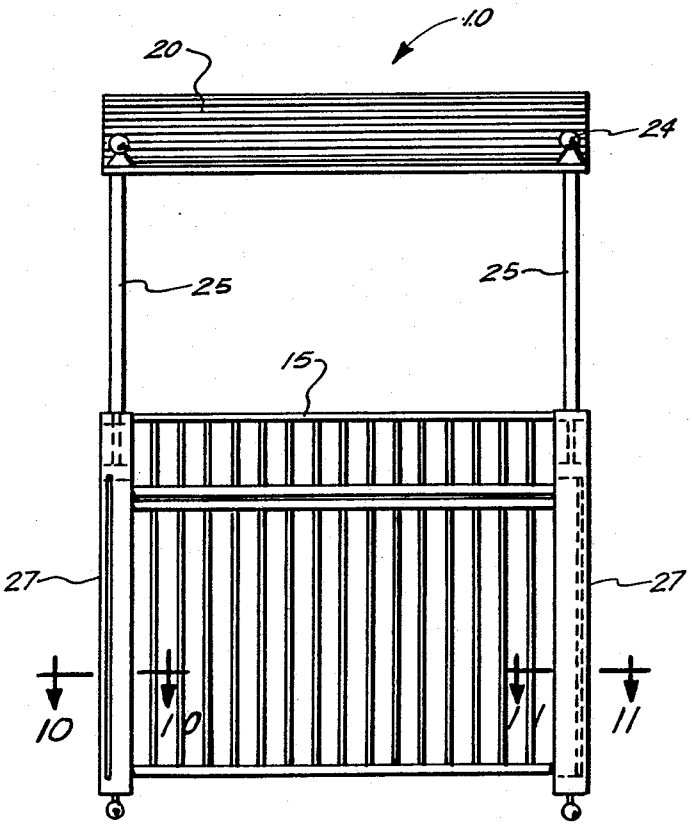
FIG. 7 is a side view of the preferred embodiment of the apparatus of the present invention.
Figure 10:
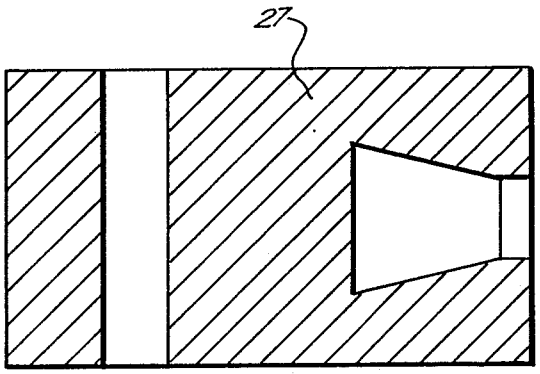
FIG. 10 is a sectional view taken along lines 10—10 of FIG. 7.
Figure 12:
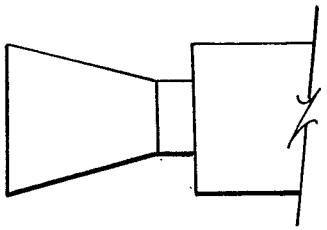
FIG. 12 is a fragmentary view illustrating one of the side rail connectors.
Figure 9:
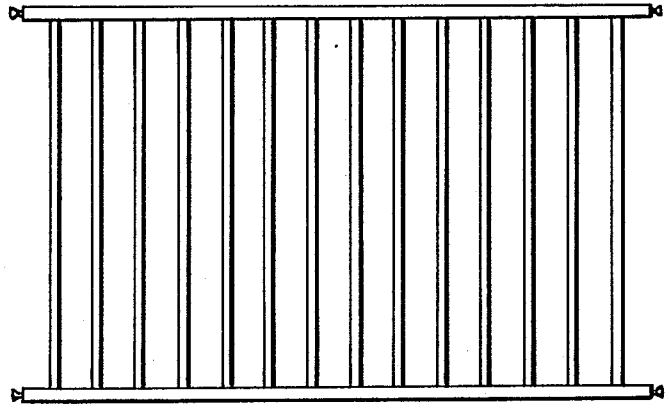
FIG. 9 is a side fragmentary view illustrating one of the rail portion of the bed frame side.
Figure 11:
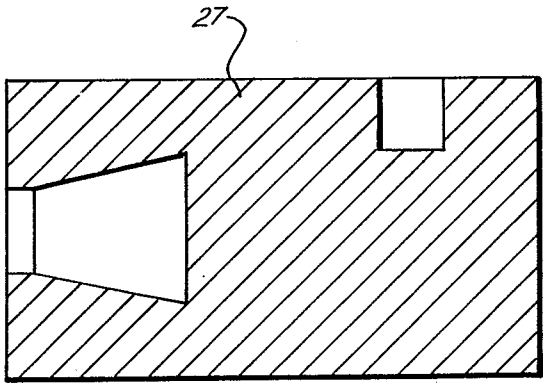
FIG. 11 is a sectional view taken along lines 11—11 of FIG. 7.

In FIGS. 3 and 5, an alternate construction of knobs 24 is shown in the form of elongated pegs 28 which would similarly provide lowermost threaded connections similar to those shown in FIG. 8, so that the pegs 28 would threadably attach to posts 25. Each of the side posts 27 of headboards 12, 13 can be provided, for example, with casters 29. A plurality of openings 30 formed in each posts 27 and facing inwardly form connections with fasteners 31 so that a connection of each fastener 31 to side posts 27 at openings 30 supports mattress 17, and more particularly, the angled iron frame 19 thereof, as best seen in FIG. 6. The fasteners 31 can be, for example, simply wing nuts having a screw threaded shaft connected thereto, or alternatively, can be in the form of elongated metal screw or pegs. The threaded knobs 24 in combination with posts 25 thus form a first removable connection for disassembling/assembling the canopy 20 and posts 25 so that the canopy 20 can be supported a distance above the top of the headboards 12, 13, so that a parent can lift an infant into or out of the bed interior 16.

With the knobs 24 and posts 25 disassembled, a second removable connection can be made by placing each threaded knob through the opening 23 of canopy 20 and threading the knobs 24 directly into the threaded connections 26 or side posts 27 to thus form a closure over the bed interior 16 with the canopy registering upon headboards 12, 13 and the upper edges of sides 14, 15 so that a toddler cannot escape the bed interior 16 by climbing over the sides 14, 15 or over a headboard 12, 13 of the bed 10. The domed canopy 20 defines an increased head room area of the bed above the sides 14, 15 to accommodate a toddler standing on the mattress 30 when the toddler's head extends above the upper surface of the sides.

Thus, the bed apparatus 10 of the present invention provides a convertible bed having increased head room and thus increased utility for a child that grows well into the toddler years, thus saving the parents substantial money which typically would be spent on a new bed once the crib became an unsafe place for the infant after the infant learned to stand, crawl and climb.

Typically, a toddler would be too heavy for the mother to lift into and out of the bed interior 16. Thus, access door 50 provides an opening in headboard 12, for example, which slides upon tracks 32, 33 formed respectively in the lower horizontal strut 34 and upper horizontal strut 35 of headboard 12. One skilled in the art will recognize that when mattress is lowered, and when canopy 20 is registered upon and connected to headboards 12, 13, as shown in FIG. 3, the toddler can enter and leave the bed interior 16 at will by operating the door 50 from either the inside or outside of the bed interior (see FIG. 4). In deed, door 37 would preferably slide completely free of headboard 12, if desired, and the bed 10 could then function as a play area for the child when covered with a decorative drape 36, having flaps 37, 38 and, for example, zipper 39 which could be operated from either inside or outside of bed interior 16.

Such a configuration as shown in FIG. 3 would have great utility for entertaining young children of the ages 3–8 years old, as the cover 36 could be made in any number of decorative artistic designed, such as, for example a small house or cottage for girls, and for example, a train, spaceship, truck for small boys. The cover 36 could have, for example, inflatable parts or projections to enhance the graphics and form of the cover such as an inflatable chimney for a house simulating cover or an inflatable rudder for a spaceship simulating cover.

Thus, the present invention provides a convertible bed apparatus having great utility for all ages infant through toddler.

I claim:

1. A convertible bed for use with both infants and toddlers up to eight (8) years in age comprising:

a. a pair of spaced apart headboards;

b. a pair of sides, at least one side having a movable portion that can be lowered, the headboards and sides defining a bed frame with an interior area;

c. a mattress support for supporting a mattress carried by the frame and vertically adjustable with respect to the frame, so that as the infant grows to be a toddler, the mattress can be lowered;

d. a domed canopy;

e. plurality of posts for supporting the canopy in a position spaced above the top of the headboards;

f. first removable connection means for disassembling/assembling the canopy and posts so that the canopy can be supported a distance above the top of the headboards so that a parent can lift an infant into or out of the bed interior;

g. second removable connection means for mounting the canopy upon the headboards to form a closure over bed interior with headboards and sides so that a toddler cannot escape the bed by climbing over the side or a headboard of the bed, the domed canopy defining an increased head room area of the bed above the sides to accommodate a toddler standing on the mattress when the toddler's head extends above the upper surface of the sides; and h. an access doorway in at least one of the headboards and operable from both inside and outside of the interior area of the bed so that a toddler can enter and leave the bed interior at will.

2. The apparatus of claim 1 wherein the access doorway includes sliding door positioned at the headboard.

3. The apparatus of claim 1 further comprising a fabric like cover having an upper portion shaped to conform to the domed canopy and sides that drape from the top portion forming an enclosure.

4. The apparatus of claim 1 wherein the first removable connection means includes threaded end portions of the posts and female threaded sockets formed on the upper portion of each of the headboards receptive of the threaded posts.

5. The apparatus of claim 1 wherein at least one of the sides includes a pair of side sections including a lower larger section and an upper smaller section each being independently removable from the bed frame.

6. The apparatus of claim 1 wherein the second removable connection means includes a plurality of pegs having means for forming threaded connections with the headboards so that the pegs can affix the domed canopy upon the headboards when the posts are removed.

7. The apparatus of claim 6 wherein the pegs have male threaded end portions.

8. The apparatus of claim 1 wherein the access doorway is a sliding doorway that can be completely removed from the bed frame by sliding laterally with respect to the bed frame and upon the bed frame.

9. The apparatus of claim 1 wherein each headboard includes upper curved portions that register with a concave curved portion of the domed canopy.

10. The apparatus of claim 1 wherein the access doorway can be operable from the inside by toddlers when the mattress is in a lower position but not by infants when the mattress is in an upper position.

* * * * *